US012714927B2

(12) United States Patent
Brodsky et al.

(10) Patent No.: US 12,714,927 B2
(45) Date of Patent: Aug. 25, 2026

(54) FLYING DISC GAME

(71) Applicant: Kash, LLC, Port Washington, NY (US)

(72) Inventors: Jeffrey Brodsky, Port Washington, NY (US); Solomon Tibebu, Alexandria, VA (US)

(73) Assignee: Kash, LLC, Port Washington, NY (US)

( * ) Notice: Subject to any disclaimer, the term of this patent is extended or adjusted under 35 U.S.C. 154(b) by 310 days.

(21) Appl. No.: 18/624,593

(22) Filed: Apr. 2, 2024

(65) Prior Publication Data

US 2025/0032875 A1 Jan. 30, 2025

Related U.S. Application Data

(60) Provisional application No. 63/528,692, filed on Jul. 25, 2023.

(51) Int. Cl.
*A63B 67/06* (2006.01)
*A63B 63/00* (2006.01)

(52) U.S. Cl.
CPC ..... *A63B 67/06* (2013.01); *A63B 63/00* (2013.01); *A63B 2063/002* (2013.01); *A63B 2210/50* (2013.01)

(58) Field of Classification Search
CPC ... A63B 67/06; A63B 63/00; A63B 2063/002; A63B 2210/50
USPC ..... 273/317
See application file for complete search history.

(56) References Cited

U.S. PATENT DOCUMENTS

| | | | | | |
|---|---|---|---|---|---|
| 3,580,536 | A * | 5/1971 | Nichols | A47B 23/044 | 248/459 |
| 5,050,889 | A * | 9/1991 | Walker | A63F 9/0204 | 273/402 |
| 5,165,695 | A * | 11/1992 | Yoder | A63B 63/00 | 273/402 |
| 5,871,216 | A * | 2/1999 | Sparacino | A63B 63/08 | 273/402 |
| 9,623,307 | B1 * | 4/2017 | Devor | A63B 63/08 | |
| 2002/0068650 | A1 * | 6/2002 | Wang | A63B 69/0071 | 473/481 |
| 2010/0072698 | A1 * | 3/2010 | Constantine | A63B 67/06 | 273/108.1 |
| 2017/0284775 | A1 * | 10/2017 | Edmiston | F41J 3/0014 | |
| 2018/0043227 | A1 * | 2/2018 | Segerstrom | A63B 67/06 | |
| 2022/0126182 | A1 * | 4/2022 | Wu | A63B 63/083 | |
| 2024/0075364 | A1 * | 3/2024 | Olive | A63B 63/08 | |
| 2025/0375684 | A1 * | 12/2025 | Williams | A63B 67/06 | |

* cited by examiner

*Primary Examiner* — Jacob K Ackun
(74) *Attorney, Agent, or Firm* — Lombard & Geliebter LLP

(57) ABSTRACT

The present application provides a gameboard that includes: a planar backboard having a pair of slots therein at laterally opposing ends of the planar backboard; a planar baseboard; and a pair of leg structures hingedly coupled to a bottom side of the planar baseboard, each of the pair of leg structure being configured to pivot inward toward a center of the planar baseboard between a folded position and an unfolded position. The pair of leg structures each have a half lap slot at a distal end of the leg structure, such that the planar backboard may be removably coupled to the planar baseboard, at a distal end of the planar baseboard, by fitting the half lap slot of each of the leg structures into one of the pair of slots in the planar backboard.

20 Claims, 18 Drawing Sheets

DETAIL A

DETAIL A

FLYING DISC GAME

The present application claims priority to U.S. Provisional Patent Application No. 63/528,692, filed Jul. 25, 2023, entitled "FLYING DISC GAME," which is hereby incorporated herein by reference.

BACKGROUND

The present application relates to games, and more specifically, outdoor games involving a gameboard and flying disc that is thrown at one or more targets on the game board.

The first traces of games were discovered in Europe, in the Bronze Age nearly 7000 years ago. Since then, humans have created thousands of games for entertainment purposes. Outdoor games are particularly popular and commonly involve a projectile that is thrown at a target to earn points. Most existing outdoor games have straightforward methods of scoring points. For example, in Kan Jam®, a team can score points for simply hitting a can or win automatically by getting the disc in a slot in the can. Although entertaining, Kan Jam® and similar games may not be engaging for some particularly over an extended period of time. Accordingly, there is a need for a game involving projectiles that provides more challenging gameplay, thereby engaging players for a longer time.

SUMMARY OF THE CLAIMED INVENTION

Figure 1:
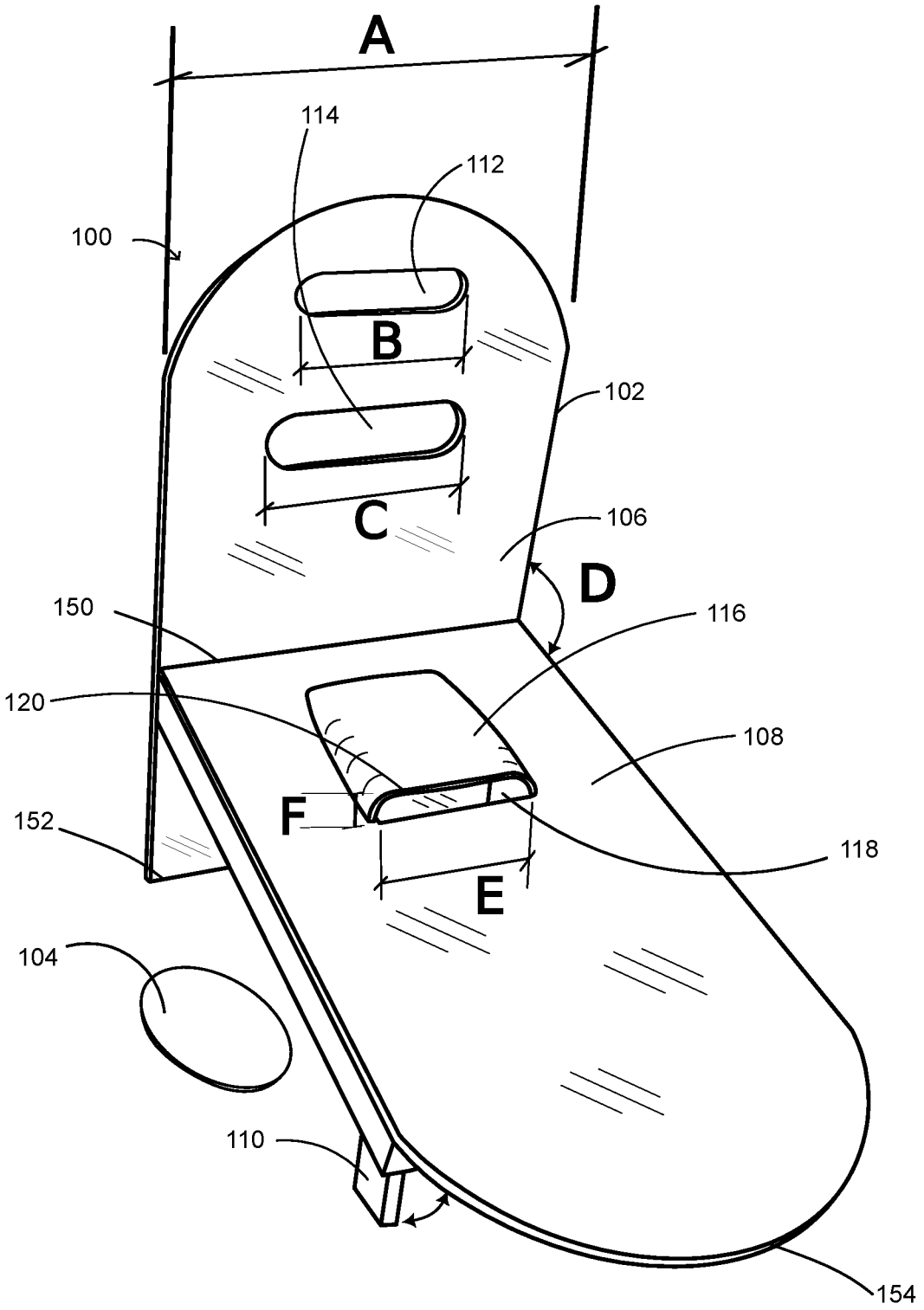
FIG. 1 is a diagram showing a flying disc game consisting of a gameboard and a projectile according to at least one embodiment of the games disclosed herein.

In one aspect, the present application provides an apparatus that includes: a planar backboard having a pair of slots therein at laterally opposing ends of the planar backboard; a planar baseboard; and a pair of leg structures hingedly coupled to a bottom side of the planar baseboard, each of the pair of leg structure being configured to pivot inward toward a center of the planar baseboard between a folded position and an unfolded position, the pair of leg structures each have a half lap slot at a distal end of the leg structure, wherein the planar backboard is removably coupled to the planar baseboard at a distal end of the planar baseboard by fitting the half lap slot of each of the leg structures into one of the pair of slots in the planar backboard.

In one embodiment, the planar backboard is oriented vertically and wherein the planar baseboard is oriented essentially horizontally.

In one embodiment, the planar backboard is oriented vertically and wherein the planar baseboard is oriented horizontally with an include toward a user.

In one embodiment, the planar baseboard is coupled to the backboard at an angle greater than 90 degrees.

In one embodiment, the angle is at least 105 degrees.

In one embodiment, the planar baseboard is elevated above the ground at both a proximal end of the planar baseboard and the distal end of the planar baseboard.

In one embodiment, the planar backboard has a plurality of horizontal slots therein spaced vertically from each other, wherein at least one of the plurality of horizontal slots has at least one dimension greater than a corresponding dimensions of another of the plurality of horizontal slots.

In one embodiment, the planar baseboard has a hole therein with a scoop located above the hole of the planar baseboard, wherein the scoop has a front facing hole.

In one embodiment, at least one of the plurality of horizontal slots has at least one dimension greater than a corresponding dimensions of the front facing hole of the scoop.

In one embodiment, the apparatus includes a projectile dimensioned to fit through the plurality of horizontal slots, the front facing hole of the scoop, and the hole in the planar baseboard.

In one embodiment, the pair of slots of the planar backboard have a shape that prevents the leg structures from being removed from the pair of slots unless the leg structures are in the folded position.

In one embodiment, the pair of slots of the planar backboard have a horizontally elongated portion and an inward protrusion located relative to each of the pair of slots to complete a half lap joint with one of the slots at the distal end of the leg structure when the leg structure is in the unfolded position.

In another aspect, an apparatus is provided that includes: a planar backboard having a pair of slots therein at laterally opposing ends of the planar backboard, wherein the planar backboard is oriented vertically; a planar baseboard, wherein the planar baseboard is oriented horizontally with an include toward a user; and a pair of leg structures hingedly coupled to a bottom side of the planar baseboard, each of the pair of leg structure being configured to pivot inward toward a center of the planar baseboard between a folded position and an unfolded position, the pair of leg structures each have a half lap slot at a distal end of the leg structure, wherein the planar backboard is removably coupled to the planar baseboard at a distal end of the planar baseboard by fitting the half lap slot of each of the leg structures into one of the pair of slots in the planar backboard, wherein the planar baseboard is elevated above the ground at both a proximal end of the planar baseboard and the distal end of the planar baseboard.

In one embodiment, the angle is at least 105 degrees.

In one embodiment, the planar backboard has a plurality of horizontal slots therein spaced vertically from each other, wherein at least one of the plurality of horizontal slots has at least one dimension greater than a corresponding dimensions of another of the plurality of horizontal slots.

In one embodiment, the planar baseboard has a hole therein with a scoop located above the hole of the planar baseboard, wherein the scoop has a front facing hole.

In one embodiment, at least one of the plurality of horizontal slots has at least one dimension greater than a corresponding dimensions of the front facing hole of the scoop.

In one embodiment, the apparatus includes a projectile dimensioned to fit through the plurality of horizontal slots, the front facing hole of the scoop, and the hole in the planar baseboard.

In one embodiment, the pair of slots of the planar backboard have a shape that prevents the leg structures from being removed from the pair of slots unless the leg structures are in the folded position.

In one embodiment, the pair of slots of the planar backboard have a horizontally elongated portion and an inward protrusion located relative to each of the pair of slots to complete a half lap joint with one of the slots at the distal end of the leg structure when the leg structure is in the unfolded position.

DETAILED DESCRIPTION OF THE INVENTION

The present application provides components for a game, i.e., a gameboard and projectile, such as a flying disk, that may be used to fulfill the need for a more engaging/challenging game.

Referring to FIG. 1, game 100 according to a preferred embodiment generally includes a gameboard 102 and a projectile 104. Each gameboard 102 includes a backboard 106, a baseboard 108, and a set of legs or leg structures 110. As can be seen the backboard 106 may generally be a planar panel oriented vertically. Baseboard 108 may similarly be a planar panel, except oriented essentially horizontally. That is, baseboard 108 may be coupled to the backboard 106 at an angle D therebetween 90 degrees or greater, preferably about 105 degrees or greater. In this regard, baseboard 108 is inclined toward the user.

Baseboard 108 has a distal end 150 that is attached to the backboard 106. Preferably, the connection occurs above the lower most edge 152 of the backboard 106, thereby elevating the distal end 150 of the baseboard 108 above the ground. This connection may be via a hinge, bolt, clip, or other means for attaching the two panels together, which allows these two panels to be folded relative to each other for storage, such that baseboard 108 and backboard 106 are oriented in a folded or otherwise compacted form for the planar panels to be parallel to each other.

At the proximal end 154 of baseboard 108, one or a plurality of legs or leg structures 110 may be attached thereto, e.g., via a hinge, bolt, or clip on the bottom side of baseboard 108 to elevate the proximal end 154 of baseboard 108 above the ground. Preferably, the distal end 150 of the baseboard 108 is higher above the ground than the proximal end 154, therewith tilting or otherwise orienting the upper surface of the backboard 106 toward the player. In one embodiment, baseboard 108 is hingedly coupled to backboard 108 with a plurality of links that cause the legs 110 to unfold outward as baseboard 108 is unfolded relative to backboard 106 from a fully collapsed position, and to fold inward as baseboard 108 is folded relative to backboard 106 from a fully upright position. The gameboard may include clip-on wheels that allow the user to roll the assembly similar to luggage.

In one embodiment, the backboard 106 includes a plurality of slots 112, 114, preferably oriented horizontally as shown. A first slot 112 may be dimensionally the same, larger, or smaller than the second slot 114, including in one or both of the vertical and horizontal dimensions. In one embodiment, baseboard 108 includes a scoop 116 attached to the to surface of baseboard 108, with a front facing hole 120, proving a third target for the user to aim for. Below/within the scoop 116 may be another hole 118, this time in baseboard 108 for the projectile 104 to pass through the front facing hole 120 in the scoop 116 and to fall through the hole 118 in the baseboard. The size of the first and second slots 112, 114, scoop 116, and scoop hole 120 may vary. Minimally, these features are dimensioned to receive the projectile, such as a flying disc 104. Scoop 116 may be removably attached to baseboard 108 so as not to interfere with the folding of the backboard 106 relative to the baseboard for storage. Legs 110 may also be pivotally attached to baseboard 108 to pivot or fold inward toward the center of baseboard 108 for flat storage.

In one embodiment, one or a plurality of sensors are functionally coupled to the baseboard 108 and/or the backboard 106 to sense when a projectile passes through the respective slot or opening in the gameboard. This information may be communicated to a controller that keeps score for one or a plurality of players, as the case may be. The controller may be a standalone unit attached to the gameboard to provide the score or other gameplay information to users via a display, for example. Alternatively or additionally, the sensors and/or the controller may send the score or other gameplay information to a mobile device in communication with the sensors and/or controller via a short range network, such as Bluetooth. The mobile device may include an app or application that allows users to enter player information and other information to track play. For example, a plurality of uniquely addressed projectiles may be used during gameplay. In this instance, the controller may be capable of identifying the uniquely addressed projectile and associate a shot being made with the unique projectile as it passes a respective slot. The gameboard may also include LED lights, a speaker, or other output devices that signal when a shot has been made and a score has been achieved. The speaker may also play audio, such as music, from the mobile device. In this regard, the gameboard may include a mobile device holder, preferably attached to the backboard 106, for users to place their mobile devices during gameplay, including to maintain the required range for music playback and game tracking, as the case may be. The holder may be attached to the front of the backboard 106, to record gameplay. Finally, the gameboard may include a cupholder, for example, on the back of the backboard 106.

In one embodiment, the planar panels are made from 0.5 inches to about 0.75 inches thick wood, plywood, or composite boards. The panels preferably have a smooth finish, such as a painted or clear coated finish over A-grade birch plywood, or the like. In one embodiment, the backboard 106 has a height of about 20 inches to about 60 inches, preferably about 40 inches, or more preferably about 41.25 inches, and a width A about 12 to about 36 inches, or preferably about 23.5 inches. In one embodiment, baseboard 108 has a length (front to back) of about 20 inches to about 60 inches, preferably about 40 inches, and a width that is about the same as the width of the backboard 106.

Backboard 108 preferably has two slots, a top slot 112 may be about 1.5 inches high by about 8-12 inches wide (B), or preferably 10 inches wide (B), and the bottom slot 114 may be about 1.5-4.5 inches high, preferably 3 inches high, by about 8-14 inches side (C), preferably 12 inches wide (C). These dimensions may vary depending on the size of the disc. These dimensions work well for an 18 cm (about 7 inches) rubber disc, but smaller or larger discs may be used. The slot dimensions may be the size of the disc plus about 1 inch to about 2 inches for the top slot 112, and plus about 2 inches to about 7 inches for the bottom slot 114. Smaller differences generally make gameplay more difficult. Scoop 116 may be about 7.5-9.6 inches wide (E), preferably 8.2 inches wide (E), by about 8-12 inches high, or preferably 10.62 inches high (front to back), each dimension may be plus or minus 1-2 inches. The hole in the front of the scoop 116 may be 1-2 inches (F), or preferably 1.29 inches wide x 9.76 inches, each dimension plus or minus 1-2 inches. Backboard 106 and baseboard 108 may connect to each other such that baseboard 108 is at an angle between about 5 degrees and about 45 degrees relative to the ground, preferably about 15 degrees relative to the ground/horizontal. Baseboard 108 may be between about 2 inches to about 6 inches off the ground. The proximal end of the leg 110 may be placed about 25-30 inches from backboard 108.

Figure 2:
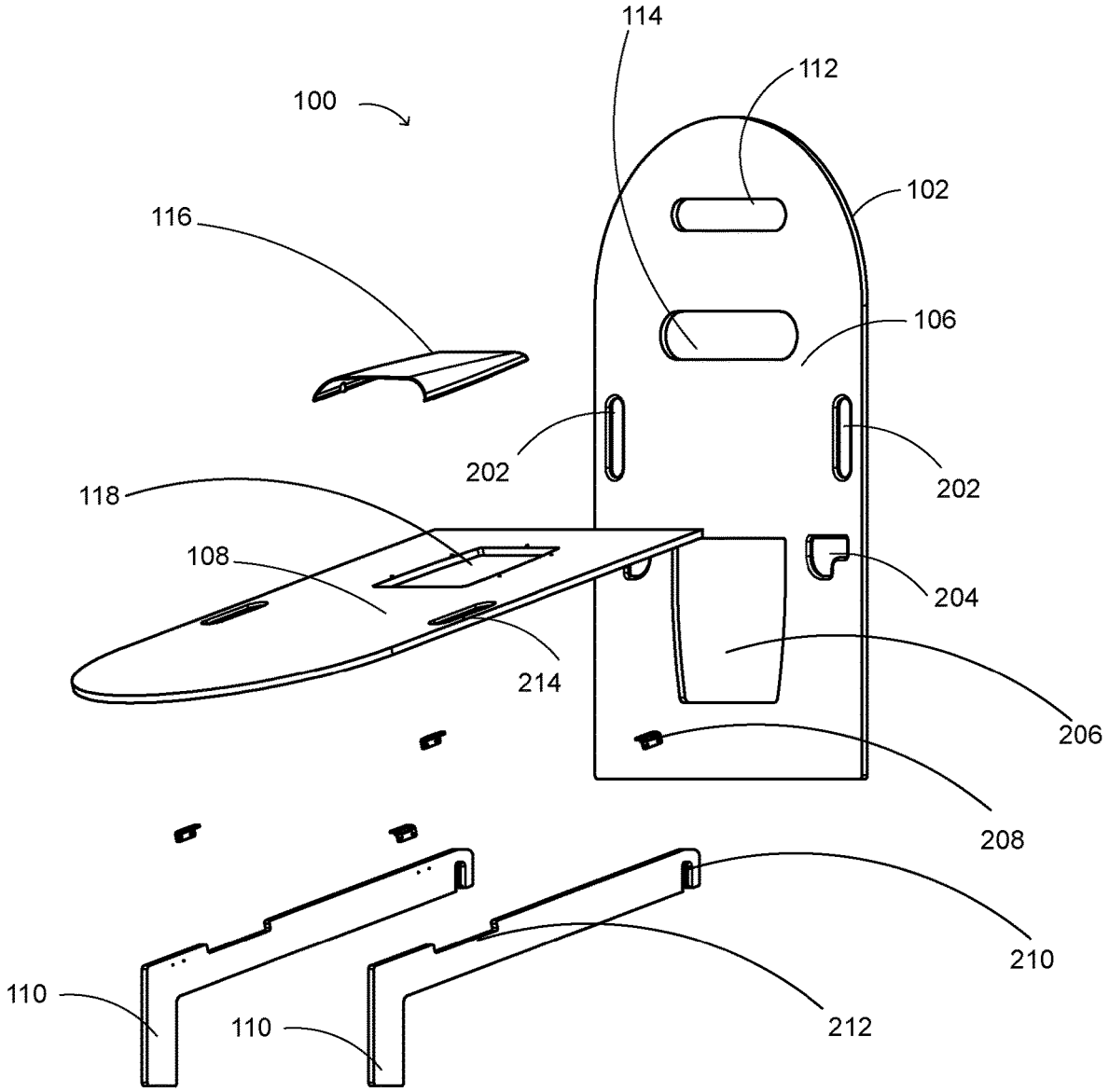
FIGS. 2-12 are several views of a flying disc gameboard according to at least one embodiment of the gameboards disclosed herein.
Figure 3:
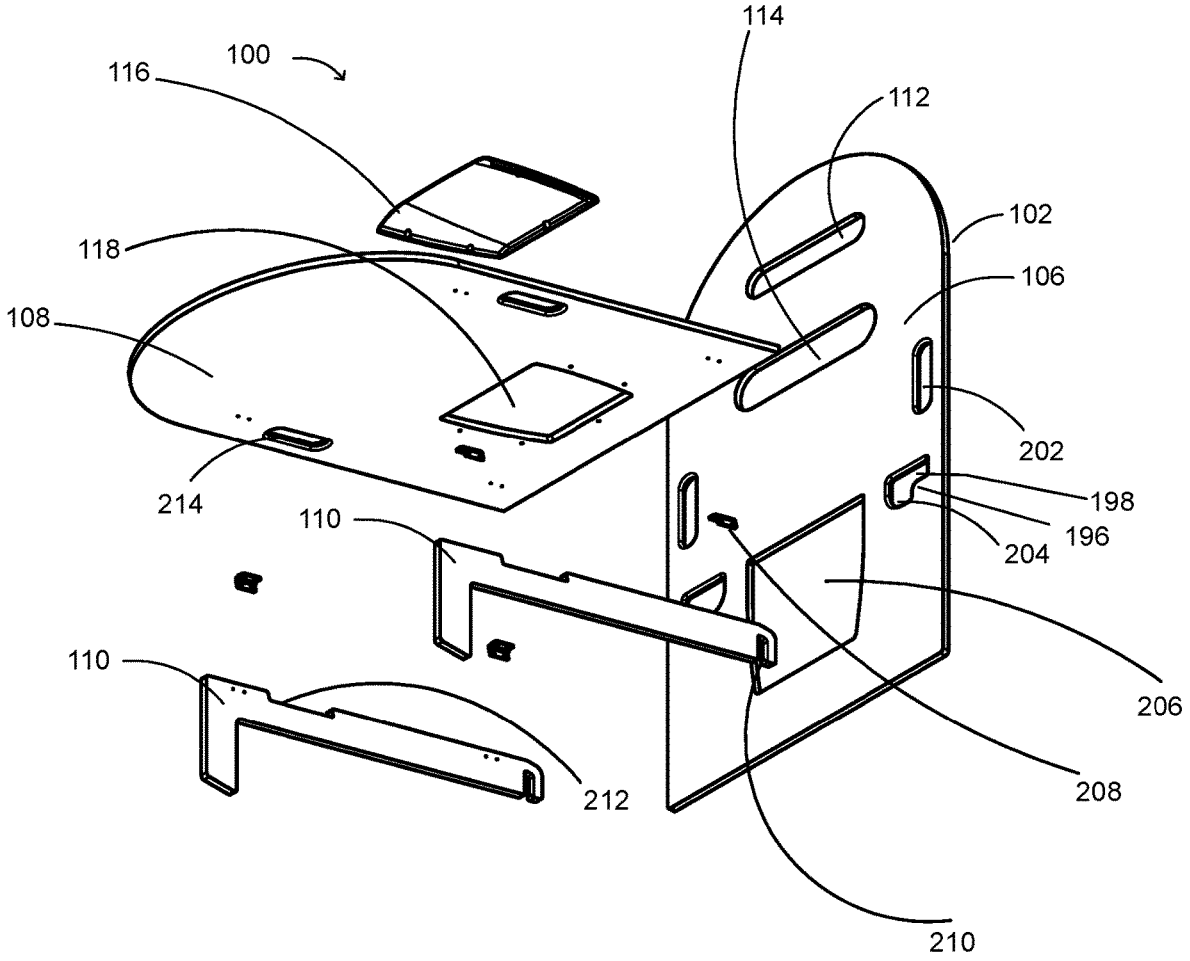
Figure 4:
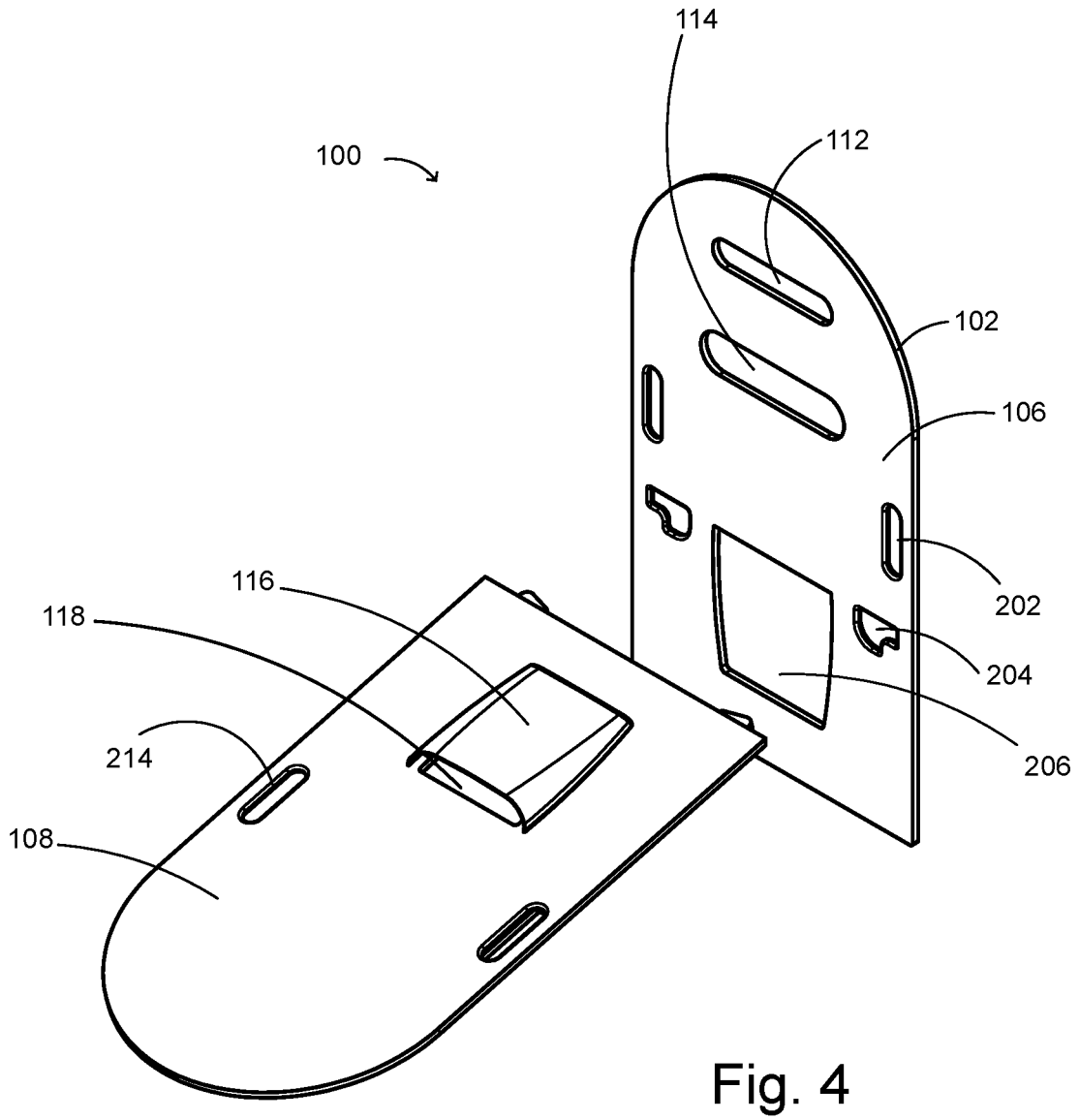
Figure 5:
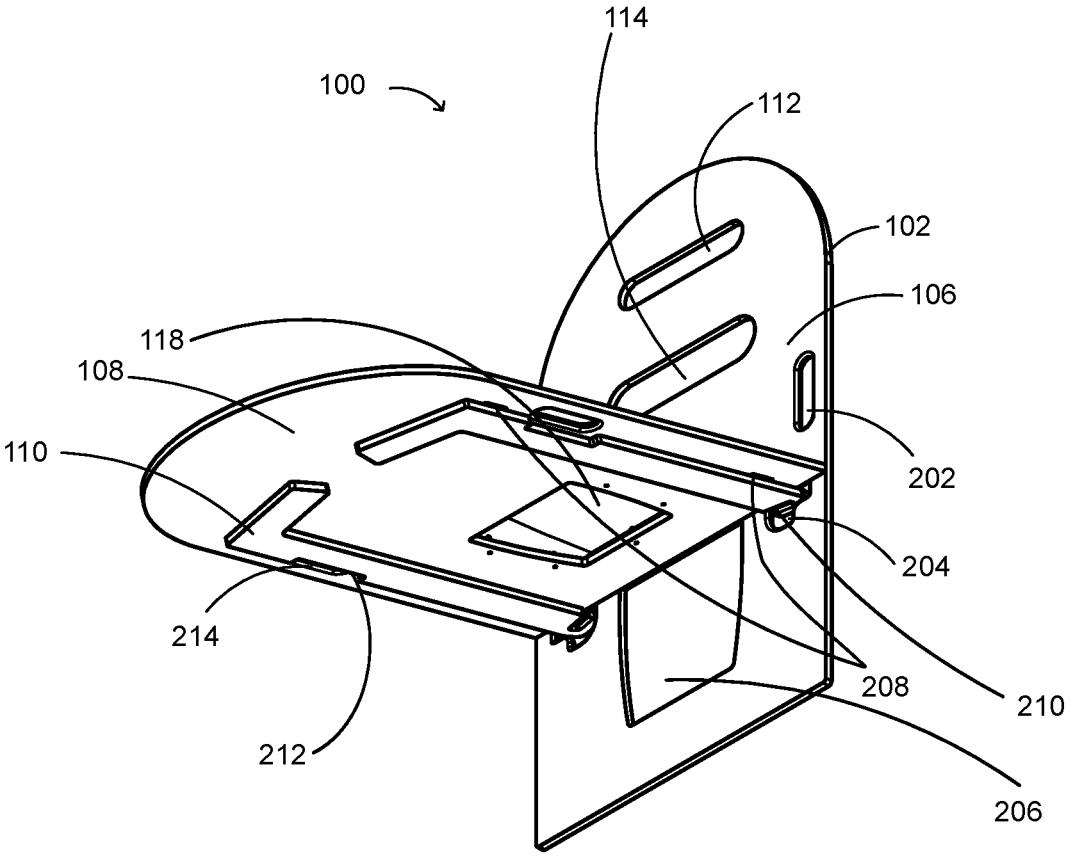

FIGS. 2-21 depict another embodiment of gameboard 102. FIG. 2 depicts an exploded view of gameboard 102 according to a second embodiment. As with the other embodiment, gameboard 102 includes a backboard 106 and baseboard 108, and a plurality of legs/leg structures 110 connected to the bottom of baseboard 108 via hinges 208. This allows the legs to be folded inwards from an unfolded position to a folded position for flat storage, as shown in FIG. 5. In this embodiment, the backboard 106 and baseboard 108 are removably attached to each other. This function may be accomplished in variety of ways. Preferably, each of the legs 110 has a distal end with a half lap slot 210 therein, which engages a corresponding slot 204 in backboard 106. The term half lap is used generally to refer to the elements of an overlapping joint, which may or may be half of a given dimension. Preferably, backboard 106 includes a plurality of slots 204 located on laterally opposing ends of backboard 106, as shown. In this embodiment, backboard 106 further includes an aperture 206 therein, located vertically below the level of the top surface of the planar baseboard 108, allowing for the user to more easily retrieve a projectile that passes through the opening 118 in baseboard 108. The backboard 106 and baseboard 108 may further include therein handles 202, 214, which may be formed as slots in the planar surfaces. In this embodiment, the leg structures 110 may include rebates 212 that clear the handle openings 214 when the leg structures 110 are disposed in the folded position, as shown in FIG. 5.

Figure 6:
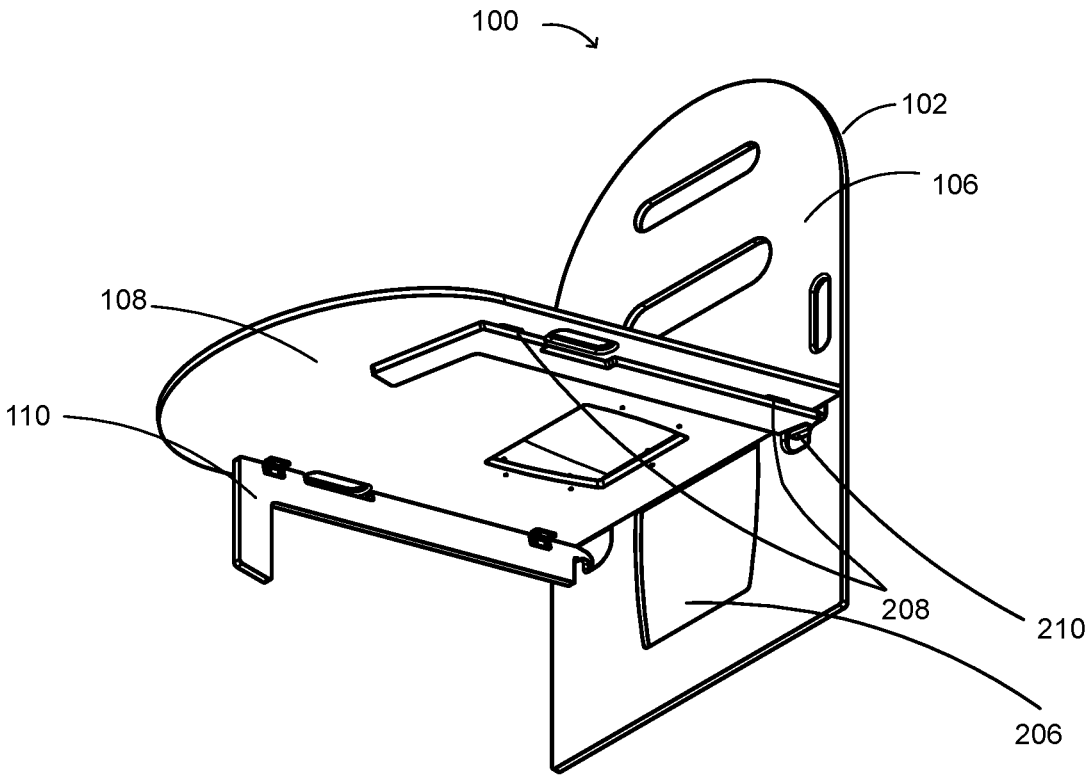
Figure 7:
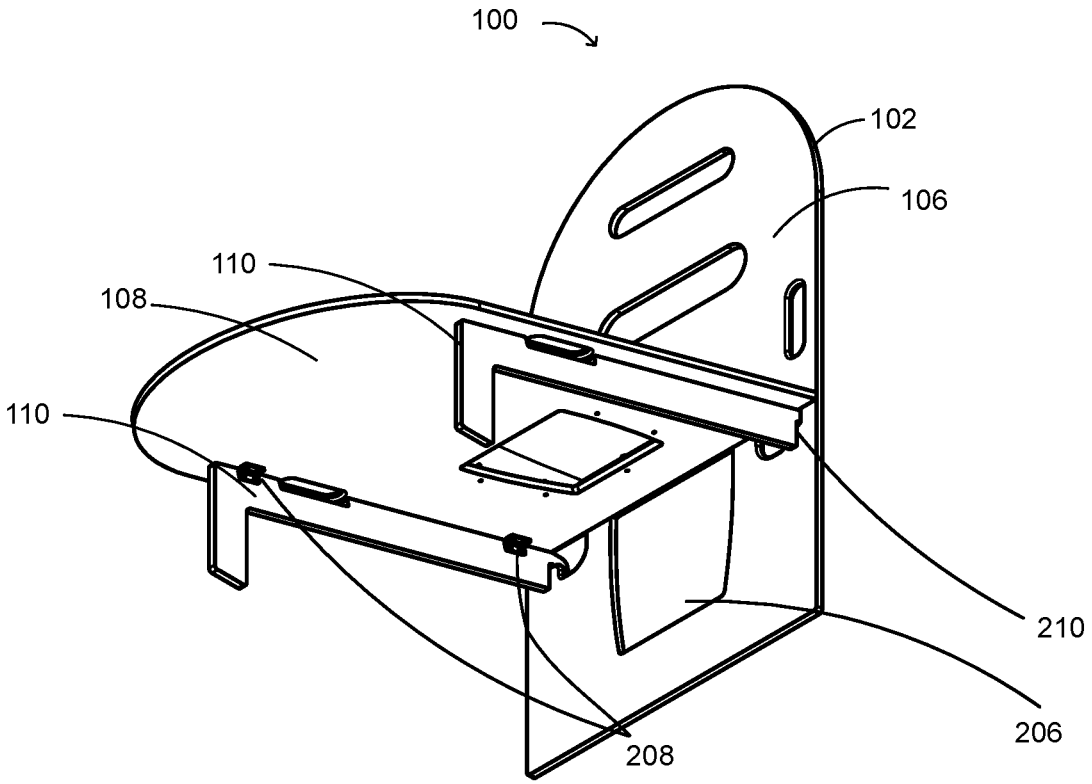
Figure 9:
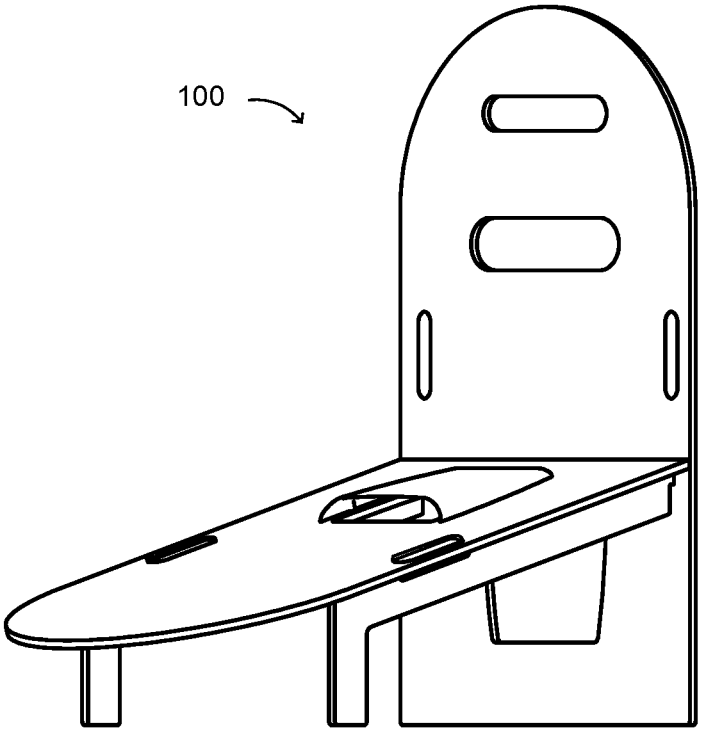
Figure 8:
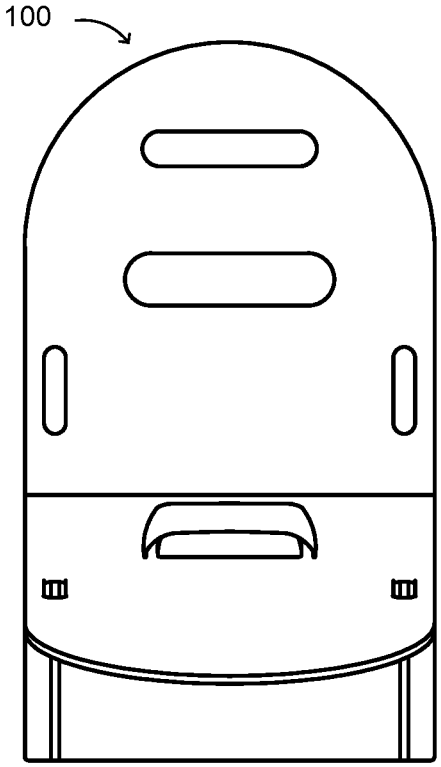
Figure 10:
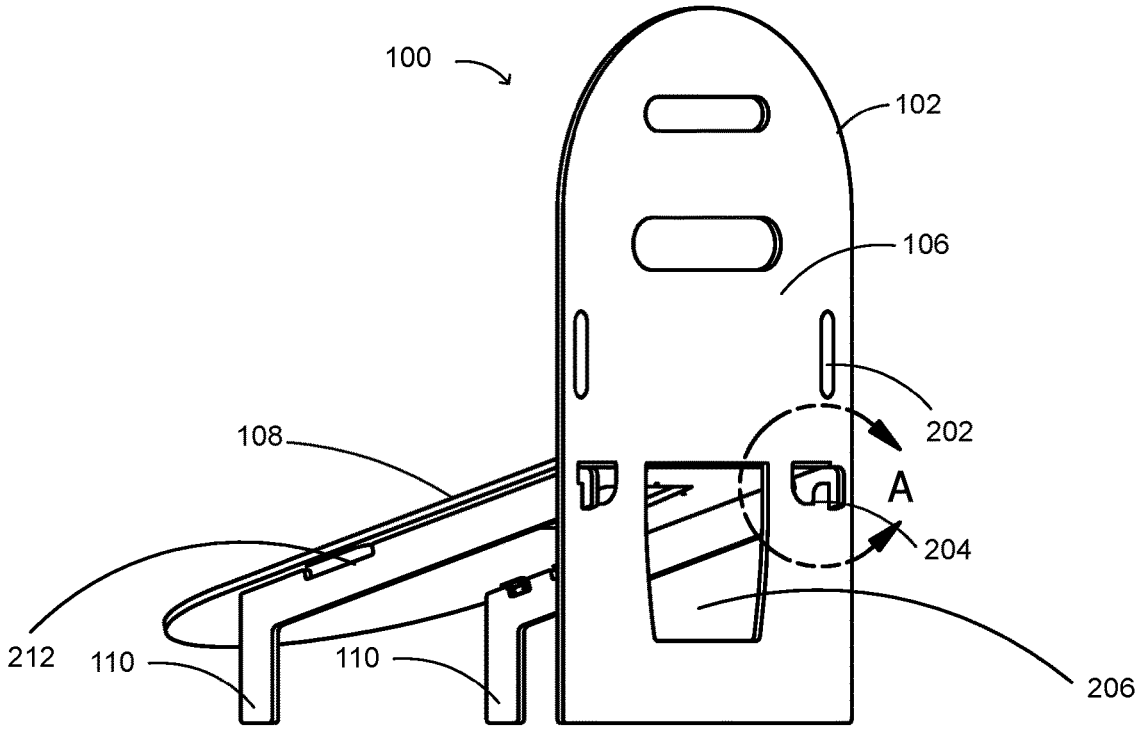
Figure 11:
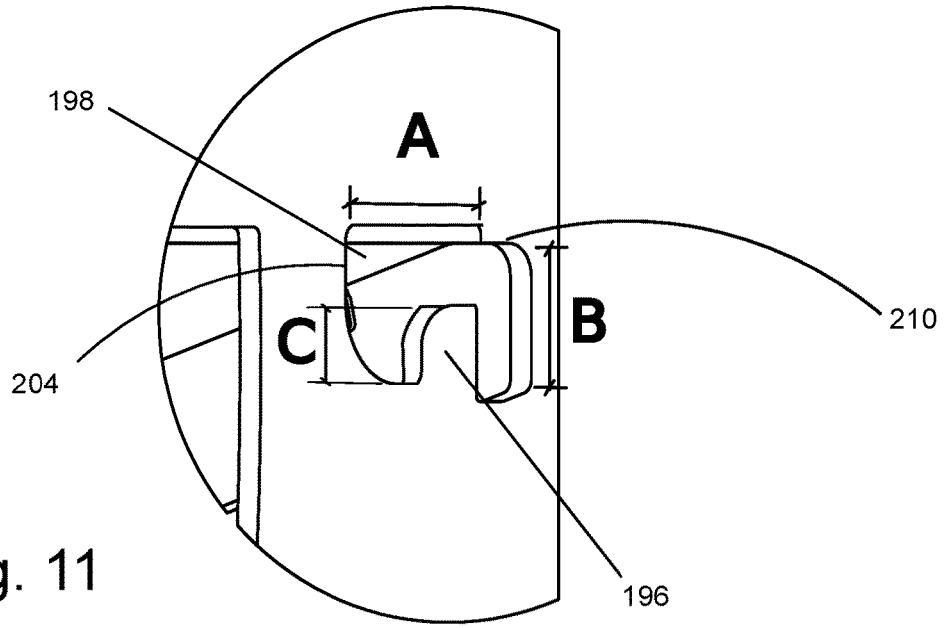
Figure 12:
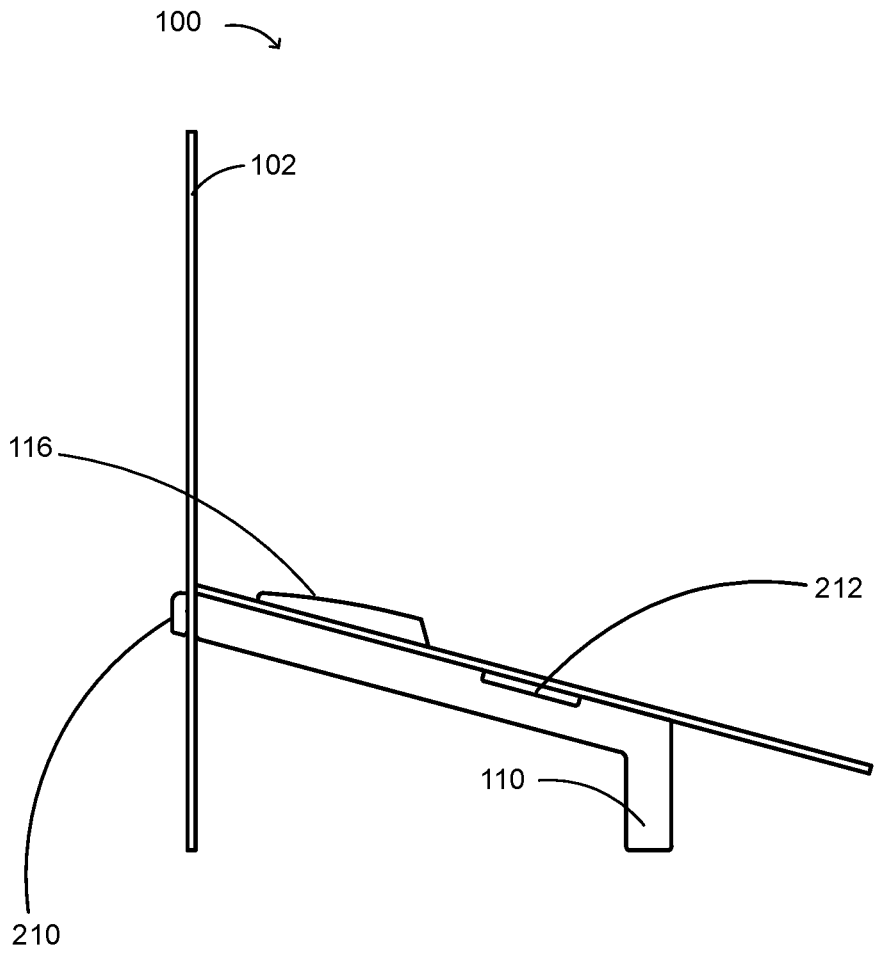
Figure 13:
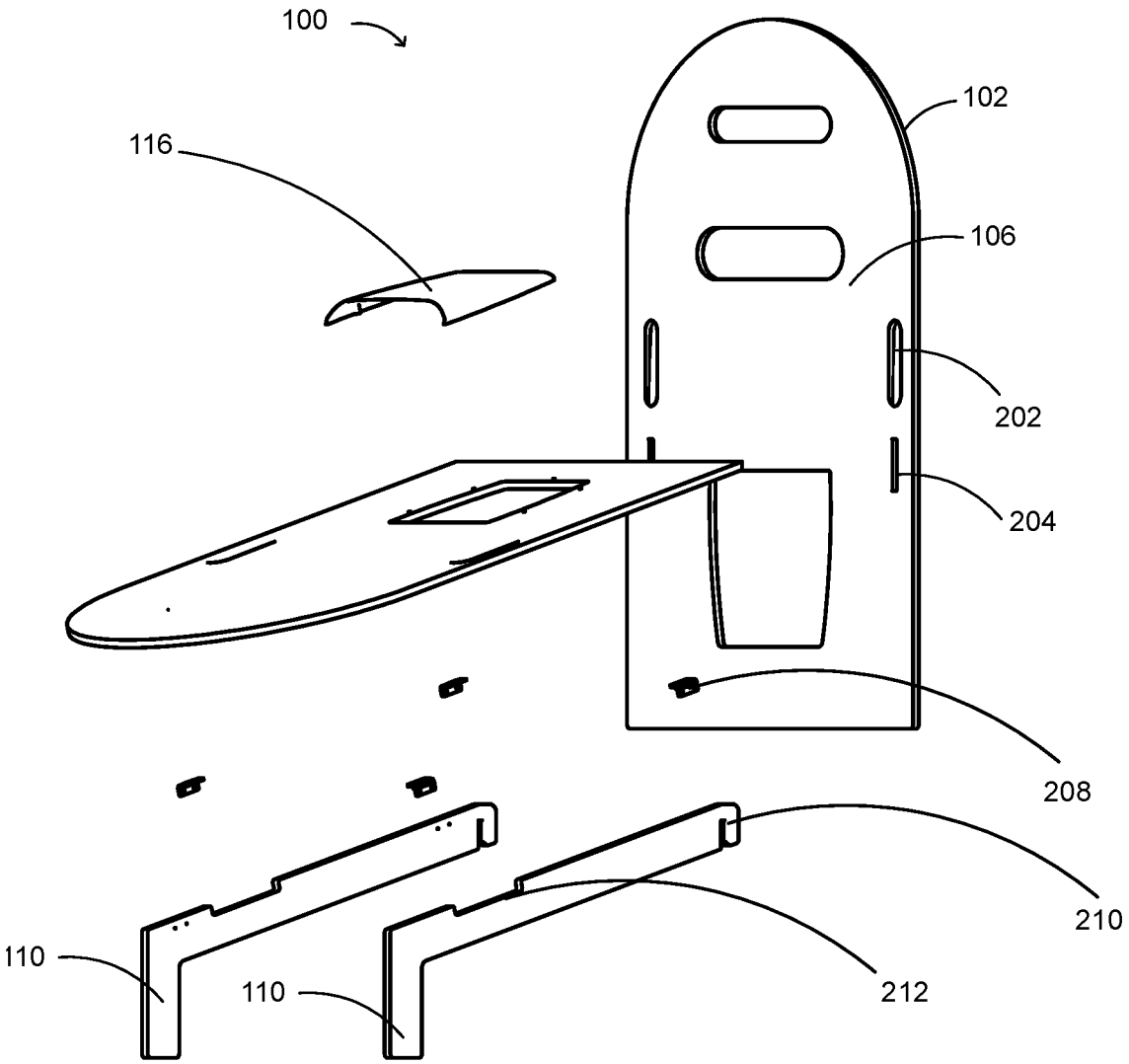
FIGS. 13-21 are several views of a flying disc gameboard according to at least one embodiment of the gameboards disclosed herein.
Figure 14:
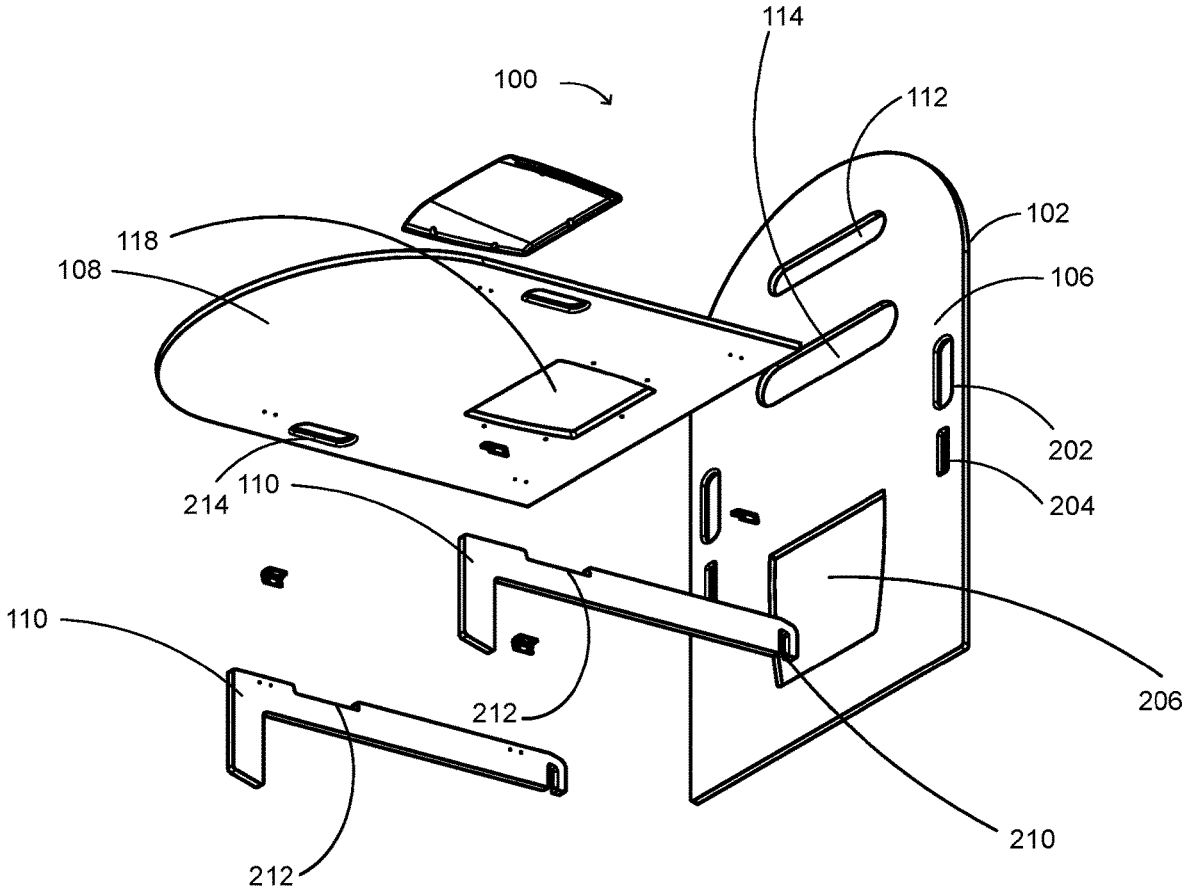
Figure 15:
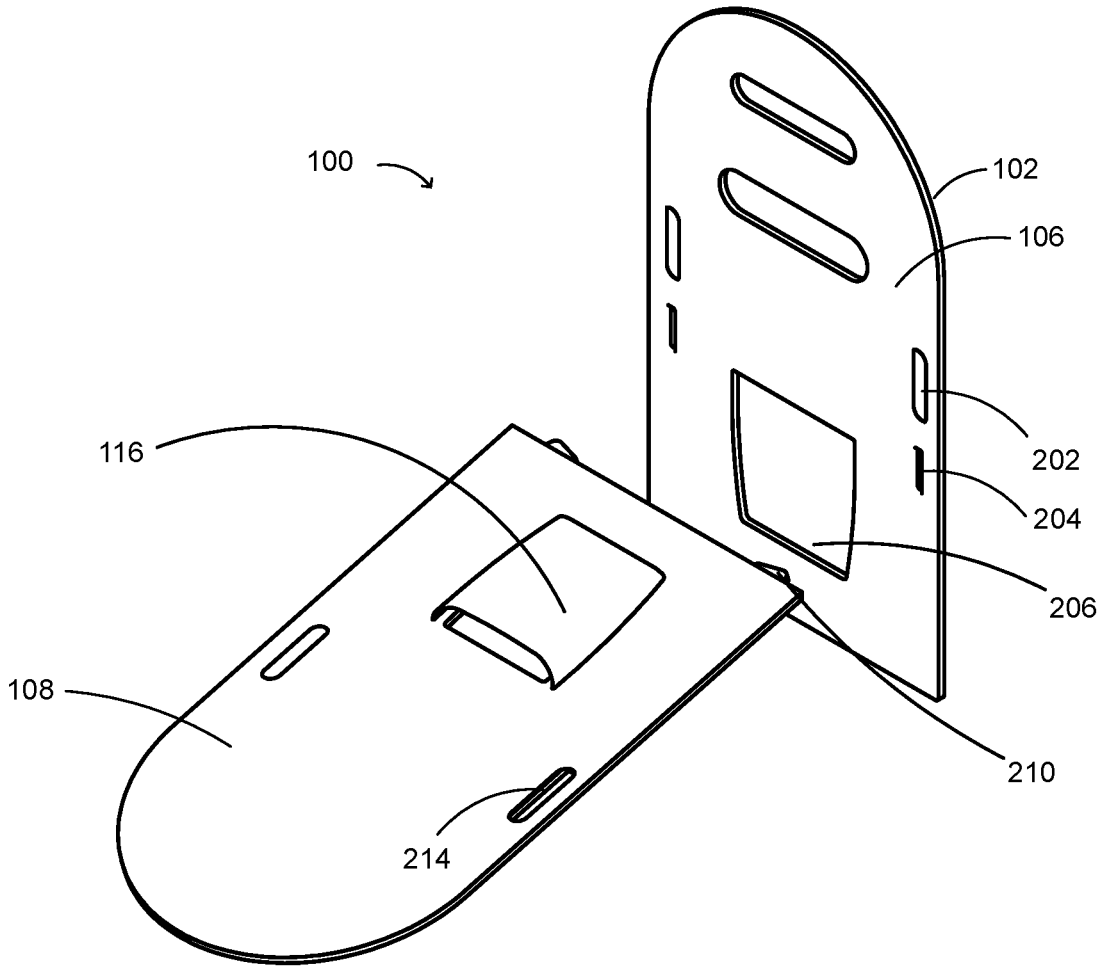
Figure 16:
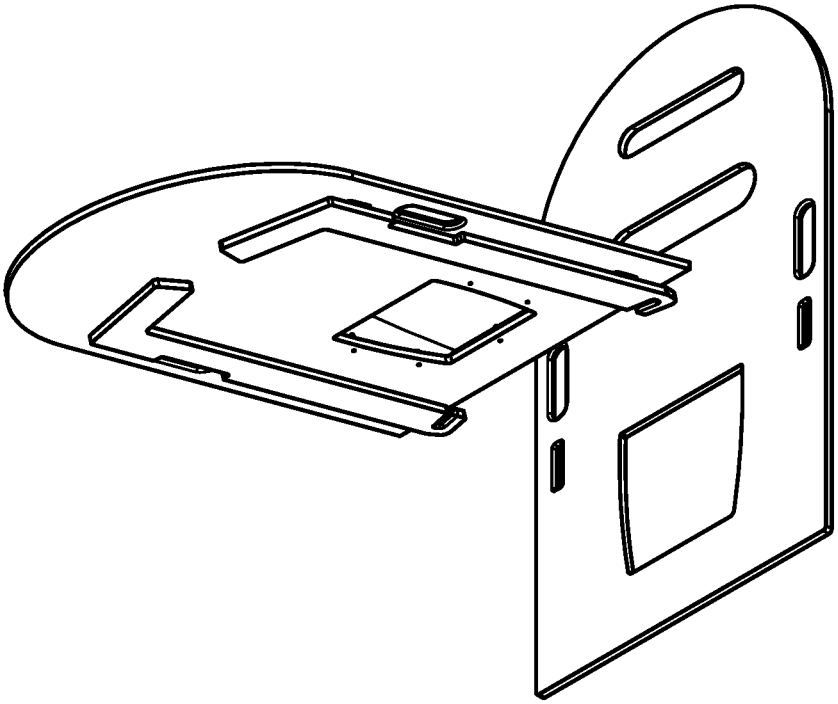
Figure 17:
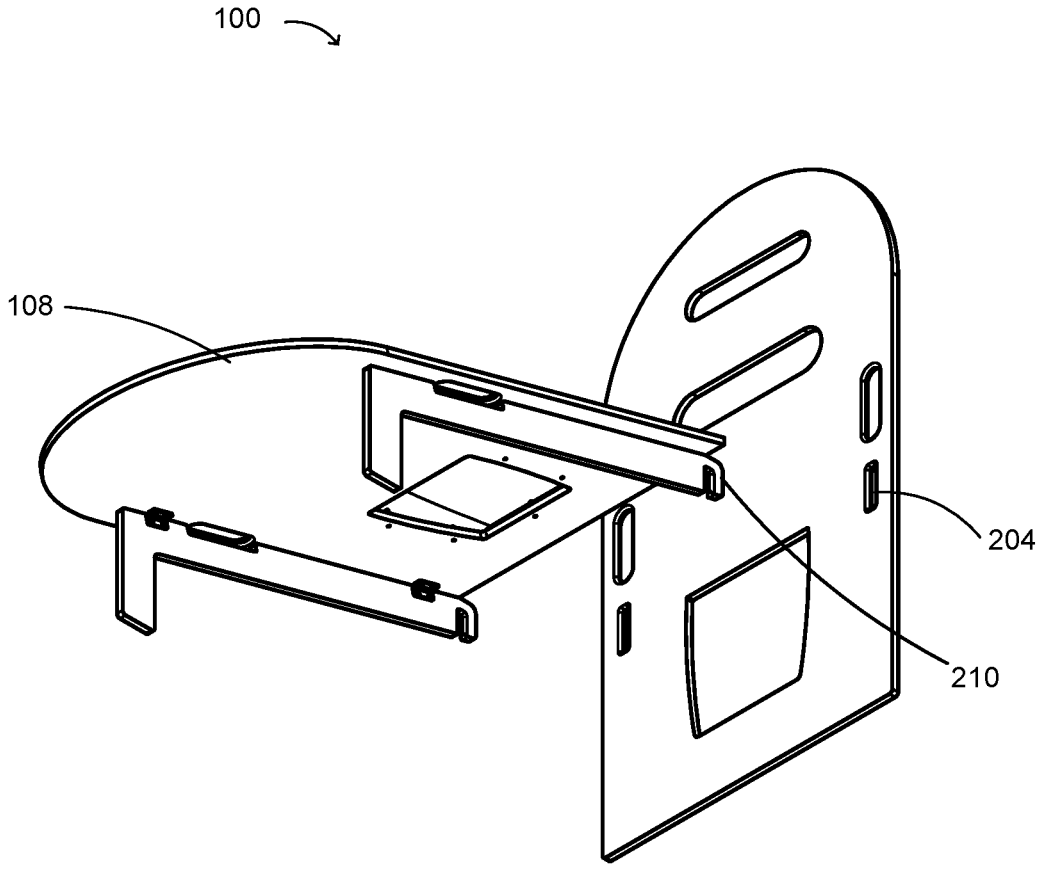
Figure 18:
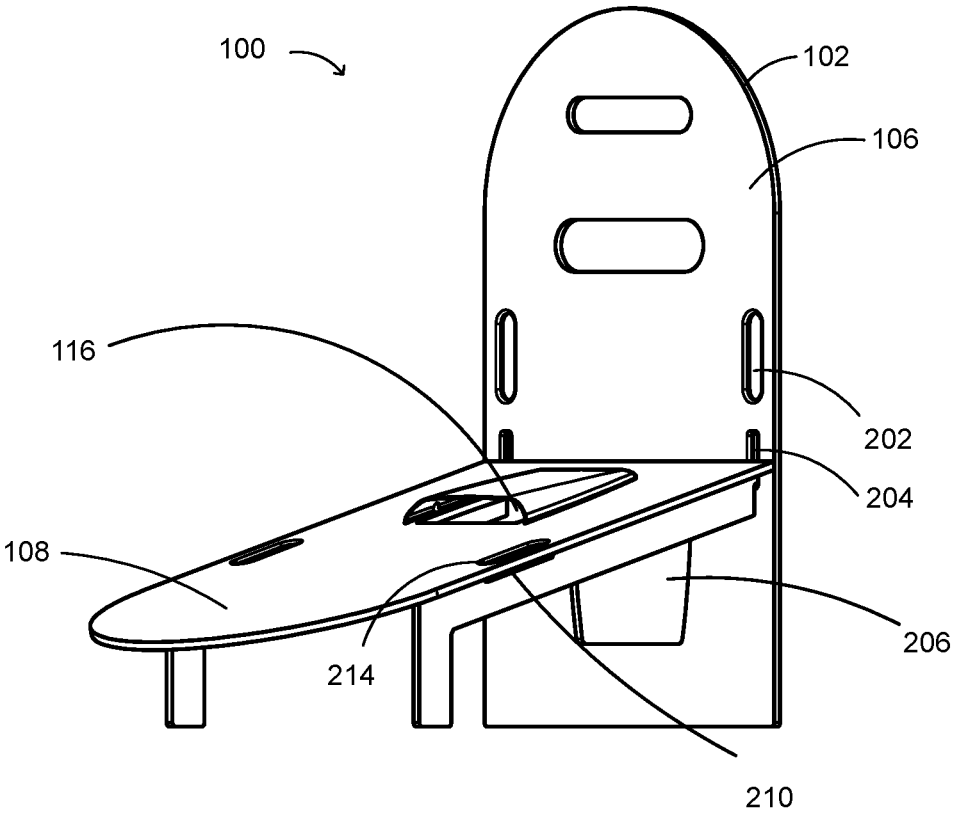
Figure 19:
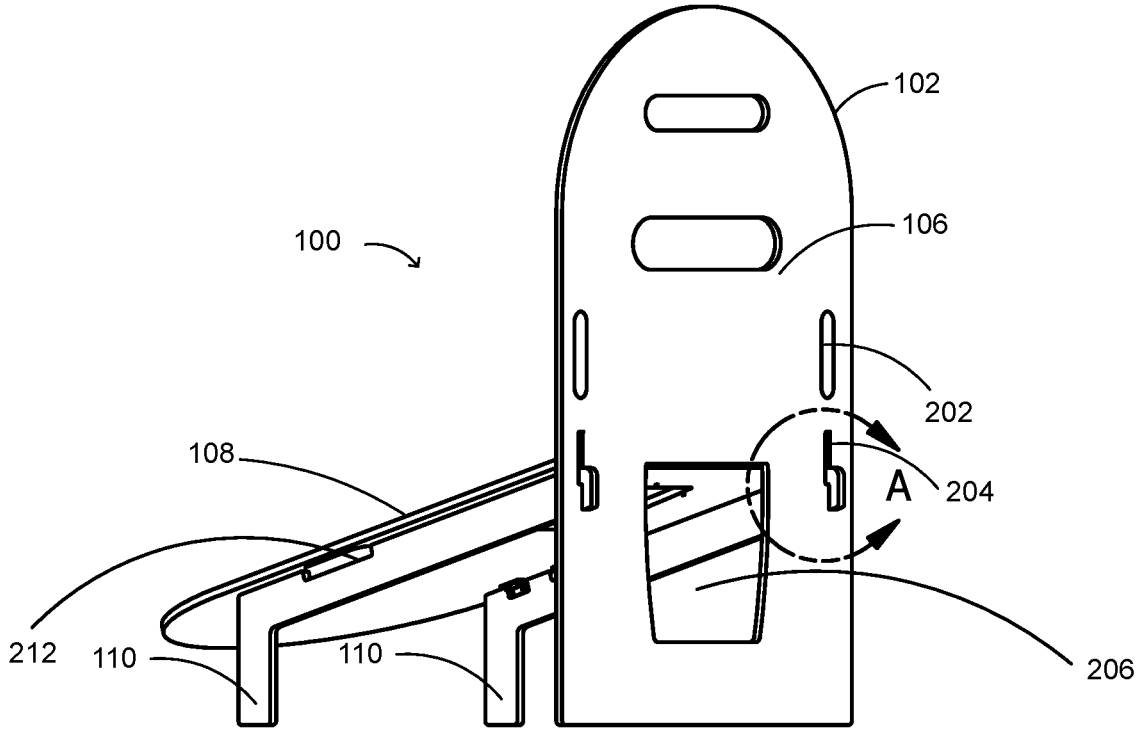
Figure 20:
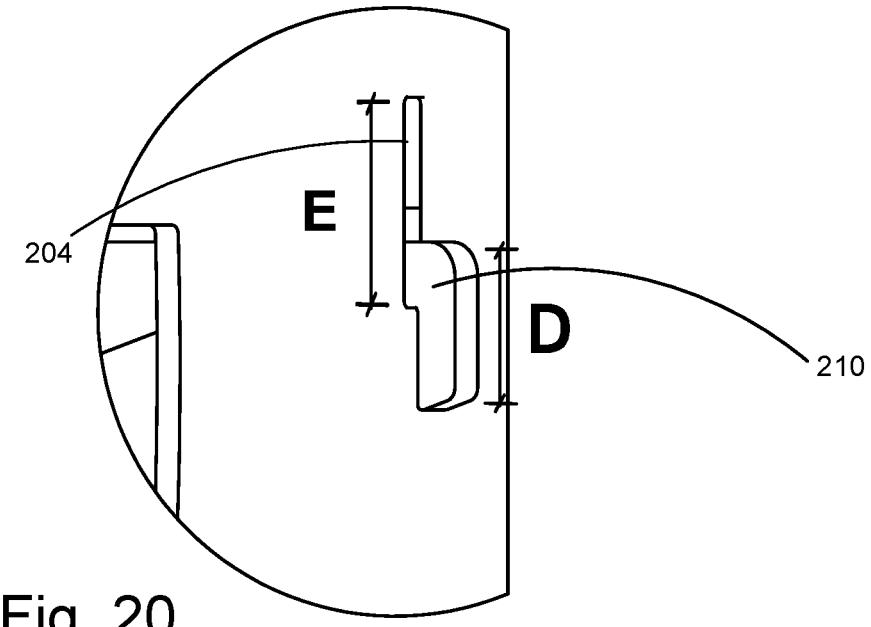
Figure 21:
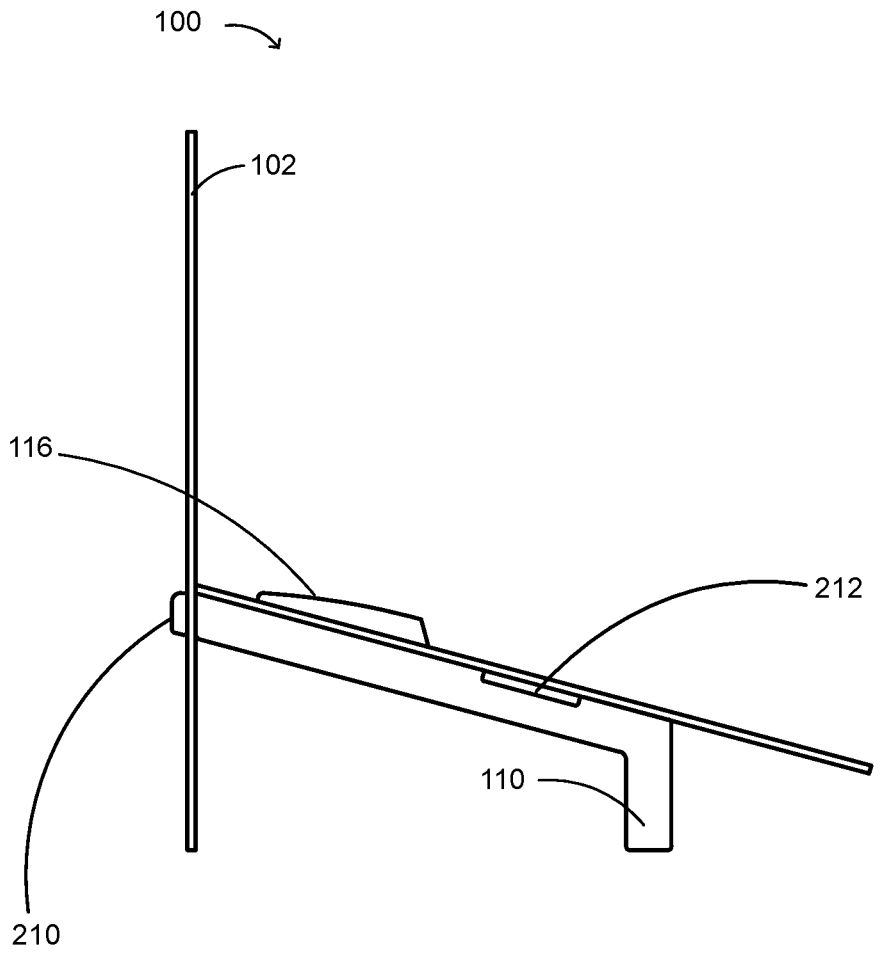

In one embodiment, the corresponding slot 204 has a geometry that prevents the legs 110 from being removed from slots 204, and therefore baseboard 108 from being disconnected from backboard 106, unless the legs 110 are disposed in the folded position. In one embodiment, this is achieved with the pair of slots 204 having a horizontally elongated portion 198 dimensioned to receive the similarly elongated distal the ends of the leg structures 110 through the backboard 106 when the legs 110 are disposed in the folded position, as shown in FIG. 5, and a bullnose protrusion 196 that extends inward into the opening of slot 204, in this instance at the bottom of the slot 204. Protrusion 196 is dimensioned to complete the half lap joint with slot 210 when the legs 110 are unfolded outwardly toward the unfolded position, as shown in FIG. 6-7. Referring to FIGS. 10-11, the rear of backboard 106 is shown with legs 110 both unfolded. As can be seen, slots 210 fit over bullnose protrusion 196, which prevents the legs 110 from being pulled out of slots 204 unless the legs 110 are folded inward for slot 210 to clear the protrusion 196. Preferably, the horizontally elongated portion 198 has a width (A) that is greater than the height (B) of slot 210. Moreover, the height (C) of protrusion 196 is sufficient to receive substantially all of slot 210. This geometry beneficially stabilizes the components and therewith prevents the gameboard 102 from racking during gameplay.

FIGS. 13-21 depict an embodiment with the vertical slot 204. In this embodiment, baseboard 108 can only be removably attached to backboard 106 when the legs 110 are unfolded fully, as shown in FIGS. 17-20. In this embodiment, the slot has a height (E) that is greater than the height D at slot 210.

Gameplay may vary. In one embodiment, the object of the game is to throw discs 104 at the gameboard 102 shown in FIG. 1 in order to gather as many points as possible. The first team/player to hit 21 points wins the game unless an automatic win is completed. The game may be played with 2-4 players. The game is preferably played using two gameboards facing each other. The gameboards may be set up about 25' apart from each other. Each team receives 5 soft rubber discs, and each player will then throw his/her disc and earn points based on where the disc lands on the gameboard. If the disc lands on baseboard 108, the team/player earns 1 point, for example. If the disc is thrown into the scoop hole 120 sufficient for the disc to fall through the hole 118 on the baseboard 108, the team/player earns 3 points. If the disc is thrown into the bottom hole 114 on the backboard 106, team/player earns 5 points. If the disc is thrown into the top hole 112 on the backboard 106, then the team/player wins automatically. If both teams earn the same number of points in a round, the points for the round cancel out and no points are awarded. If team/player throws the disc through the automatic win hole, the losing team/player has the opportunity to throw each of their discs into the automatic win hole. If the losing team/player gets a disc into the automatic win hole, the game continues, otherwise the other team/player wins.

While the foregoing invention has been described in some detail for purposes of clarity and understanding, it will be appreciated by one skilled in the art, from a reading of the disclosure, that various changes in form and detail can be made without departing from the true scope of the invention.

The invention claimed is:

1. An apparatus comprising:

a planar backboard having a pair of slots therein at laterally opposing ends of the planar backboard;

a planar baseboard; and a pair of leg structures hingedly coupled to a bottom side of the planar baseboard, each of the pair of leg structure being configured to pivot inward toward a center of the planar baseboard between a folded position and an unfolded position, the pair of leg structures each have a half lap slot at a distal end of the leg structure, wherein the planar backboard is removably coupled to the planar baseboard, at a distal end of the planar baseboard, by fitting the half lap slot of each of the leg structures into one of the pair of slots in the planar backboard.

2. The apparatus of claim 1, wherein the planar backboard is oriented vertically and wherein the planar baseboard is oriented essentially horizontally.

3. The apparatus of claim 1, wherein the planar backboard is oriented vertically and wherein the planar baseboard is oriented horizontally with an include toward a user.

4. The apparatus of claim 3, wherein the planar baseboard is coupled to the backboard at an angle greater than 90 degrees.

5. The apparatus of claim 4, wherein the angle is at least 105 degrees.

6. The apparatus of claim 1, wherein the planar baseboard is elevated above the ground at both a proximal end of the planar baseboard and the distal end of the planar baseboard.

7. The apparatus of claim 1, wherein the planar backboard has a plurality of horizontal slots therein spaced vertically from each other, wherein at least one of the plurality of horizontal slots has at least one dimension greater than a corresponding dimensions of another of the plurality of horizontal slots.

8. The apparatus of claim 7, wherein the planar baseboard has a hole therein with a scoop located above the hole of the planar baseboard, wherein the scoop has a front facing hole.

9. The apparatus of claim 8, wherein at least one of the plurality of horizontal slots has at least one dimension greater than a corresponding dimensions of the front facing hole of the scoop.

10. The apparatus of claim 9, comprising a projectile dimensioned to fit through the plurality of horizontal slots, the front facing hole of the scoop, and the hole in the planar baseboard.

11. The apparatus of claim 1, wherein the pair of slots of the planar backboard have a shape that prevents the leg structures from being removed from the pair of slots unless the leg structures are in the folded position.

12. The apparatus of claim 1, wherein the pair of slots of the planar backboard have a horizontally elongated portion and an inward protrusion located relative to each of the pair of slots to complete a half lap joint with one of the slots at the distal end of the leg structure when the leg structure is in the unfolded position.

13. An apparatus comprising:

a planar backboard having a pair of slots therein at laterally opposing ends of the planar backboard, wherein the planar backboard is oriented vertically;

a planar baseboard, wherein the planar baseboard is oriented horizontally with an include toward a user; and a pair of leg structures hingedly coupled to a bottom side of the planar baseboard, each of the pair of leg structure being configured to pivot inward toward a center of the planar baseboard between a folded position and an unfolded position, the pair of leg structures each have a half lap slot at a distal end of the leg structure, wherein the planar backboard is removably coupled to the planar baseboard, at a distal end of the planar baseboard, by fitting the half lap slot of each of the leg structures into one of the pair of slots in the planar backboard, and wherein the planar baseboard is elevated above the ground at both a proximal end of the planar baseboard and the distal end of the planar baseboard.

14. The apparatus of claim 13, wherein the angle is at least 105 degrees.

15. The apparatus of claim 13, wherein the planar backboard has a plurality of horizontal slots therein spaced vertically from each other, wherein at least one of the plurality of horizontal slots has at least one dimension greater than a corresponding dimensions of another of the plurality of horizontal slots.

16. The apparatus of claim 15, wherein the planar baseboard has a hole therein with a scoop located above the hole of the planar baseboard, wherein the scoop has a front facing hole.

17. The apparatus of claim 16, wherein at least one of the plurality of horizontal slots has at least one dimension greater than a corresponding dimensions of the front facing hole of the scoop.

18. The apparatus of claim 17, comprising a projectile dimensioned to fit through the plurality of horizontal slots, the front facing hole of the scoop, and the hole in the planar baseboard.

19. The apparatus of claim 18, wherein the pair of slots of the planar backboard have a shape that prevents the leg structures from being removed from the pair of slots unless the leg structures are in the folded position.

20. The apparatus of claim 17, wherein the pair of slots of the planar backboard have a horizontally elongated portion and an inward protrusion located relative to each of the pair of slots to complete a half lap joint with one of the slots at the distal end of the leg structure when the leg structure is in the unfolded position.

* * * * *